US008847087B2

(12) United States Patent
Naito et al.

(10) Patent No.: US 8,847,087 B2
(45) Date of Patent: Sep. 30, 2014

(54) MEMS SWITCH AND COMMUNICATION DEVICE USING THE SAME

(75) Inventors: Yasuyuki Naito, Osaka (JP); Xavier Rottenberg, Schaarbeek (BE); Jan Bienstman, Kessel-lo (BE); Hendrikus A. C. Tilmans, Maasmechelen (BE)

(73) Assignees: Panasonic Corporation, Osaka (JP); IMEC, Leuven (BE)

( * ) Notice: Subject to any disclaimer, the term of this patent is extended or adjusted under 35 U.S.C. 154(b) by 116 days.

(21) Appl. No.: 13/262,666

(22) PCT Filed: Aug. 26, 2010

(86) PCT No.: PCT/JP2010/005269

§ 371 (c)(1),
(2), (4) Date: Oct. 3, 2011

(87) PCT Pub. No.: WO2011/033729

PCT Pub. Date: Mar. 24, 2011

(65) Prior Publication Data

US 2012/0031744 A1 Feb. 9, 2012

(30) Foreign Application Priority Data

Sep. 17, 2009 (JP) ..... P 2009-215844

(51) Int. Cl.
*H01H 1/50* (2006.01)
*H01H 59/00* (2006.01)

(52) U.S. Cl.
CPC ..... *H01H 59/0009* (2013.01); *H01H 2059/0072* (2013.01)
USPC ..... 200/181

(58) Field of Classification Search
CPC ..... H01H 59/0009; H01H 2059/0072
See application file for complete search history.

(56) References Cited

U.S. PATENT DOCUMENTS 6,046,659 A * 4/2000 Loo et al. ..... 333/262
6,115,231 A * 9/2000 Shirakawa ..... 361/233

(Continued)

FOREIGN PATENT DOCUMENTS

JP 2003-136496 5/2003
JP 2006-269127 10/2006

(Continued)

OTHER PUBLICATIONS

International Search Report issued Nov. 22, 2010 in International (PCT) Application No. PCT/JP2010/005269.

(Continued)

*Primary Examiner* — Renee S Luebke
*Assistant Examiner* — Ahmed Saeed
(74) *Attorney, Agent, or Firm* — Wenderoth, Lind & Ponack, L.L.P.

(57) ABSTRACT

A MEMS switch is provided wherein contact force sufficient to make a contact having low contact resistance is maintained after contact-formation to maintain low contact resistance at the signal transmission contact in "on" state. Provided is a MEMS switch 100 including a first electrode 101, a second electrode 104 opposed to and separated from the first electrode, a third and a fourth electrodes 1021 and 1022, wherein electrical contact is made between the electrodes 101 and 104 by electrostatic force generated between the electrode 101 and the electrodes 1021, 1022, and a bump which can form the contact between the electrode 101 and the electrode 1021 and/or 1022 is provided on the electrode 101, and a gap is formed between the electrode 101 and the electrode 1021 and/or 1022 when the electrical contact is made, and control signals are input to the electrodes 1021 and 1022 independently.

21 Claims, 9 Drawing Sheets

(56) References Cited

U.S. PATENT DOCUMENTS

| | | | | |
|---|---|---|---|---|
| 6,608,268 | B1 * | 8/2003 | Goldsmith | 200/181 |
| 6,787,438 | B1 * | 9/2004 | Nelson | 438/584 |
| 7,161,273 | B2 * | 1/2007 | Akiba et al. | 310/309 |
| 7,352,266 | B2 * | 4/2008 | Chou | 335/78 |
| 7,362,199 | B2 * | 4/2008 | Chou et al. | 335/78 |
| 2002/0163408 | A1 | 11/2002 | Fujii et al. | |
| 2003/0102771 | A1 | 6/2003 | Akiba et al. | |
| 2004/0040828 | A1 * | 3/2004 | Ivanciw et al. | 200/600 |
| 2005/0062565 | A1 * | 3/2005 | Chou | 335/78 |
| 2005/0280975 | A1 | 12/2005 | Iwata et al. | |
| 2008/0283374 | A1 | 11/2008 | Naito | |

FOREIGN PATENT DOCUMENTS

| | | |
|---|---|---|
| JP | 2008-311225 | 12/2008 |
| WO | 01/82323 | 11/2001 |

OTHER PUBLICATIONS

International Preliminary Report on Patentability and Written Opinion of the International Searching Authority, issued Apr. 11, 2012 in International (PCT) Application No. PCT/JP2010/005269.

* cited by examiner

MEMS SWITCH AND COMMUNICATION DEVICE USING THE SAME

TECHNICAL FIELD

The present invention relates to a MEMS switch which is one of microelectromechanical systems and a communication device using the same.

BACKGROUND ART

Microelectromechanical system (which may be abbreviated to "MEMS") can fulfill various functions in wide-ranging fields such as wireless technologies, optical technologies, acceleration sensors and biotechnologies. MEMS, in particular, is favorably used in a device such as a switch and a filter for a wireless terminal.

As an information and communication device such as a wireless terminal is being in widespread use, a small-sized terminal that is accommodated to various communication systems is required. In addition, it is recently desired to downsize a passive component since there is a tendency of increase in the number of the passive components, such as a switch, which are built in a housing of the terminal.

A radio-frequency microelectromechanical system (RF-MEMS) switch, which is manufactured using a MEMS technology, is regarded as a favorable component to satisfy these demands. The RF-MEMS switch is a switch wherein a micro movable electrode is moved to mechanically switch a transmission path of a signal. The advantage of the RF-MEMS switch is excellent radio-frequency characteristics such as ultra-low insertion loss, high isolation, linearity and so on. Further, since the MEMS switch can be produced by a process compatible to a semiconductor, the MEMS switch can be built in an RF-IC. For these reasons, the development of the MEMS switch is expected to be a technology which significantly contributes to downscaling of the wireless segment.

The conventional RF-MEMS switch mechanically switches the transmission path of signal by contacting a membrane or bar movable body having a fixed-fixed beam construction or a cantilever construction with an electrode, or separating the movable body from the electrode. Many conventional RF-MEMS switches use electrostatic force as a source of driving force for the movable body. The RF MEMS switch wherein electromagnetic force is used as a source of driving force has been proposed.

There is a series-type switch as one type of the RF-MEMS switches. The series-type RF-MEMS has a movable electrode and a driving electrode. The movable electrode, which is a micro membrane with a length of several hundreds μm is located on extension of the signal line for transmitting an RF signal and is separated from a signal electrode. A tip of the movable electrode is open. The driving electrode is provided just beneath the region where the membrane of the movable electrode is not located. When a DC potential is applied to the driving electrode, the movable electrode is attracted to the driving electrode side by the electrostatic force, and then contacted with the signal line which outputs the signal. The short circuit is established between the signal lines and the RF signal is transmitted through the movable electrode (that is, "on" state is established). When the DC potential is not applied to the driving electrode, the movable electrode does not contact with the signal line and thereby the RF signal is blocked (that is, "off" state is established).

An example of a construction of the conventional series-type MEMS switch is described with reference to FIGS. 7 and 8. FIG. 7 is a top view showing an example of the conventional MEMS switch, and FIG. 8 is a cross-sectional view showing the A-A' section in FIG. 7.

In the MEMS switch 500 shown in the figure, an insulating layer 509 is formed as an interlayer insulating film on a substrate 510, and a driving electrode 502 and a signal electrode 504 as the transmission path are formed on the insulating layer 509. A movable electrode 501, which has a contact electrode (membrane) 503 and is supported by a support 505, is provided such that the electrode 501 is opposed to and separated from the electrodes 502 and 504. The movable electrode 501 is a deformable member and formed on only one side when viewed from the contact electrode 503 (that is, the electrode 501 is a cantilever beam). The switch of this construction is made "on" by applying the electrostatic force between the movable electrode 501 and the driving electrode 502 to electrically contact the contact electrode 503 with the signal electrode 504.

Further, an electrostatic type relay is disclosed in Patent Document 1, as another embodiment of the microelectromechanical system switch. The switch disclosed in Patent Document 1 is of a construction wherein the movable electrode which is elastically supported is made into surface contact with a fixed electrode by the electrostatic force.

BACKGROUND ART DOCUMENT

Patent Document

Patent Document 1: WO 01/82323

SUMMARY OF INVENTION

Problems to be Solved by the Invention

Currently contact resistance at a contact where the signal is transmitted is required to be kept low in order to achieve the low insertion loss in the switching "on" state. However, there is a problem that the contact resistance is made high due to the oxide film formed on a surface of a metal constituting the electrode, or the pollution of the electrode surface, resulting in the decrease in reliability of the contact. The oxide film and the polluted region can be physically removed or broken using a mechanical cleaning effect which is obtained by, for example, scratching and piercing a metal surface. The mechanical cleaning effect is obtained by physical force which is applied upon the formation of electrical contact. However, when such mechanical effect cannot be obtained sufficiently, it is necessary to increase the driving voltage to increase the contact force such that higher mechanical cleaning effect and a lower contact resistance are given. This means that a more electric power is consumed by the switch. Further, the reliability of the contact is also decreased by a stiction phenomenon (an adhesion phenomenon) wherein the contact is difficult to separate after the contact is made. This stiction is prone to occur when the driving voltage is high.

In the switch of the construction disclosed in Patent Document 1, since the fixed electrodes are located on both sides of the contact, a surface contact is made between the contact electrode 503 and the signal electrode 504. In the switch of the surface contact type, the problem of the decrease of reliability due to the stiction (the adhesion phenomenon) is prone to occur. Further, since the switch of Patent Document 1 has a construction wherein a metal-to-metal connection is formed by driving an electrostatic-type actuator with one driving electrode and one control signal to press the contact in one axial direction, a large contact force, that is, a large driving voltage is needed to obtain the mechanical cleaning effect.

The present invention was made in view of the above-described situation, and the object of the present invention is to provide a MEMS switch which can make a highly reliable contact.

Means to Solve the Problem

The present invention provides a MEMS switch including:

a movable electrode, a signal electrode which is separated from and opposed to the movable electrode, and a counter electrode which is separated from and opposed to the movable electrode, wherein, an electrical contact can be made between the movable electrode and the signal electrode by electrostatic force generated between the movable electrode and the counter electrode, an electrical voltage for generating the electrostatic force between the movable electrode and the counter electrode is to be applied to one of the movable electrode and the counter electrode, the electrode to which the electrical voltage is to be applied is divided into two or more separate electrodes, the electrical voltage is applied to the respective-separate electrodes with a time difference.

The MEMS switch of the present invention is characterized in that one of the movable electrode and the counter electrode between which and the movable electrode the electrostatic force is generated is divided into two or more separate electrodes and the voltage is applied to the separate electrodes with a time difference. Such application of the voltage is possible by inputting the control signals to the respective separate electrodes independently. The time difference in the application of the voltage enables the movable electrode to slide upon the formation of the contact between the movable electrode and the signal electrode, whereby the mechanical cleaning effect is obtained and the stabilization of the contact formation can be achieved in the repeated operations.

Therefore, the MEMS switch of the present invention can realize the formation of the highly reliable contact which makes the low contact resistance and the low insertion loss at a low driving voltage.

The voltage is preferably applied to the separate electrodes with the time difference approximately equal to a response time of the switch. Higher mechanical cleaning effect can be obtained by making the time difference approximately equal to the response time of the switch.

In the MEMS switch of the present invention, the separate electrodes are preferably placed symmetrically about the electrical contact. Such arrangement gives higher mechanical cleaning effect.

In the MEMS switch of the present invention, when the movable electrode is the first electrode and the signal electrode is the second electrode, it is preferable that the counter electrode is divided into two separate electrodes to form a third electrode and a fourth electrode. The division of the counter electrode enables easier circuit design and easier production compared to the division of the movable electrode. Further, the division of the counter electrode into two separate electrodes makes it easy to arrange the electrode to which the voltage is applied with the time difference such that the electrode is symmetrical about the electrical contact.

In the MEMS switch which includes the third electrode and the fourth electrode, the bump which can form the contact between the first electrode and the third electrode and/or the fourth electrode is preferably provided on one or more electrodes selected from the first electrode, the third electrode and the fourth electrode. When the electrical contact is made between the first electrode and the second electrode, the gap is formed between the first electrode and the third electrode and/or the fourth electrode due to the presence of the bump. For this reason, high contact force can be maintained by, in addition to the spring force of the first electrode, the electrostatic force which acts between the first electrode and the third electrode and/or the fourth electrode, after the first electrode and the second electrode contact electrically.

The number and the position of the bump are preferably selected such that the first electrode and the third electrode and/or the fourth electrode are not contacted each other directly, when the electrical contact is made. Thereby, the region of the gap can be increased. As a result, the electrostatic capacitance can be increased to increase the electrostatic force which contributes to the retention of the electrical contact when the first electrode and the second electrode contact with each other.

In the case where two or more bumps are provided in the MEMS switch of the present invention, the respective bumps are preferably formed on the respective radial lines which extend from the electrical contact. In that case, the bumps are preferably located such that the distances between the respective bumps and the electrical contact are equal. In other words, it is preferable that the bumps are located on a circle, the center of which is the electrical contact. By locating the respective bumps on the respective radial lines, the bumps are located two-dimensionally, and the movable electrode bridged over a region enclosed by the electrical contact and the bumps has not only a length but also a width, resulting in the increase in the spring force of the movable electrode. Further, this disposition of the bumps can ensure the gap between the first electrode and the third electrode (between the first electrode and the third electrode and/or the fourth electrode when the fourth electrode is provided) during the period when the electrical contact is formed.

When two or more bumps are formed on the first electrode and/or the third electrode, the number and the positions of the humps are preferably selected such that an area of a region enclosed by the electrical contact between the first electrode and the second electrode and the bumps is 20% or more of the area where the electrostatic force acts between the first electrode and the third electrode, when the MEMS is viewed from above (in other words, in a direction in which the first electrode is moved (warped) when the first electrode and the second electrode make the electrical contact). As the region which is enclosed by the electrical contact and the bumps is larger, the electrostatic force which contributes to the retention of the electrical contact in the state wherein the first electrode and the second electrode contact, can be made larger. When a plurality of bumps are formed on the fourth electrode in the MEMS switch of the present invention, it is preferable that the bumps are formed similarly.

It is preferable that the third electrode and the fourth electrode are located such that they sandwich the electrical contact, and it is more preferable that they are symmetrically located such that the electrical contact is on a center line of symmetry, when viewed from above. Such a construction gives higher mechanical cleaning effect. Further, this construction makes it possible to apply uniform contact force having no bias to the entire electrical contact, avoiding the dispersion of the contact force.

In the case where the third electrode and the fourth electrode are included and the bump is provided in the MEMS switch, the first electrode at the electrical contact is preferably located at a higher position than the first electrode at the bump. Such a construction makes it possible to maintain also the contact force conferred by the spring force after the contact is made.

In the MEMS switch of the present invention, the movable electrode (the first electrode) is preferably a fixed-fixed beam. When the first electrode is of the fixed-fixed beam construction with the both ends fixed and the application of the voltage is conducted with the time difference to generate a time difference in the occurrence of the warp of the movable electrode, the movable electrode which is attracted to one side is surely dragged by the fixed end of the other side. Thereby the movable electrode more surely slides on the surface of the signal electrode (the second electrode).

The present invention also provides a communication device including the MEMS switch of the present invention. The communication device of the present invention is highly reliable and can be driven by low power, due to the high reliability and the low insertion loss of the switch.

Effect of the Invention

The MEMS switch of the present invention realizes the formation of the electrical contact of high reliability which was difficult to realize in the conventional MEMS switch.

DESCRIPTION OF EMBODIMENTS

Hereinafter, embodiments of the present invention will be described in detail with reference to the accompanying drawings.

First Embodiment

Figure 1:
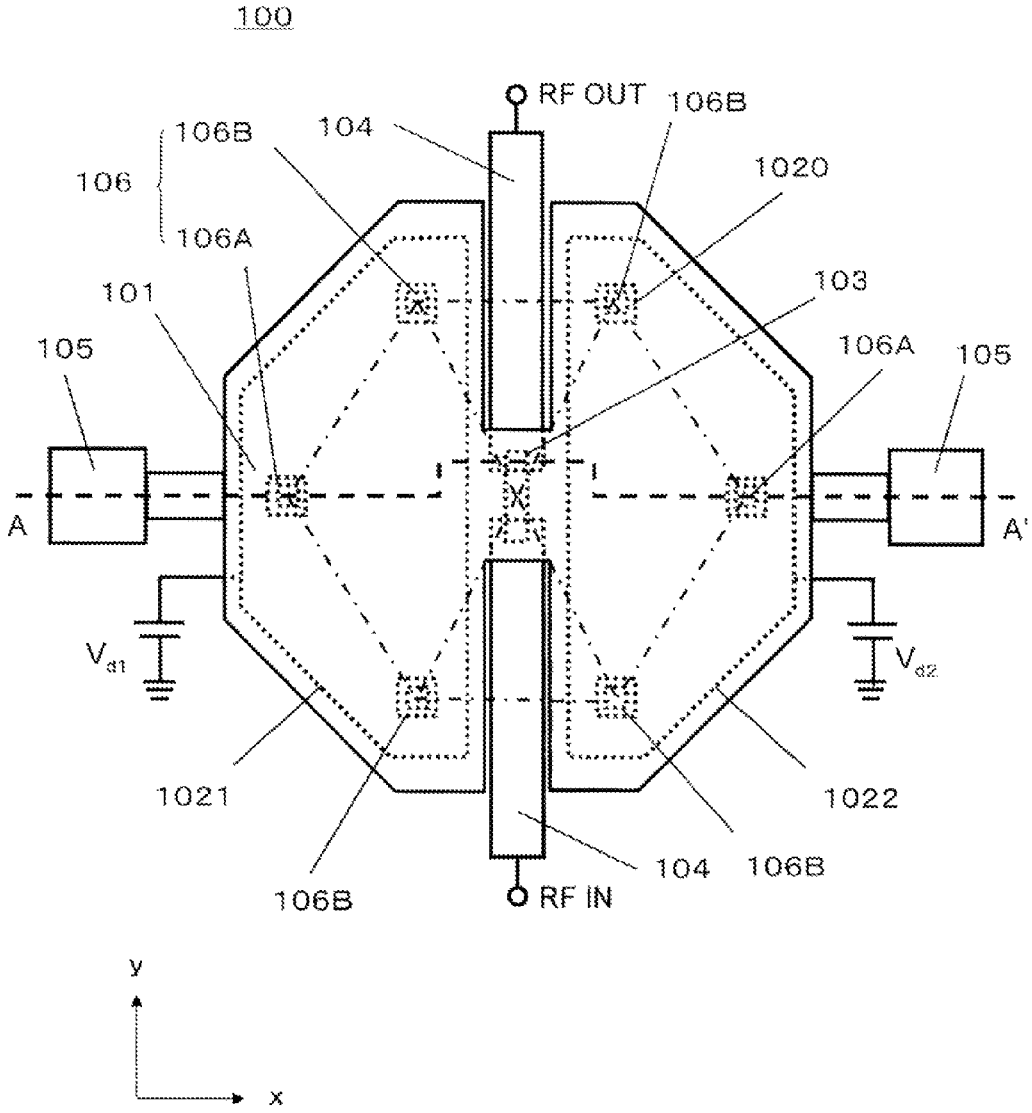
FIG. 1 is a top view showing a construction of a MEMS switch according to a first embodiment of the present invention.
Figure 2:
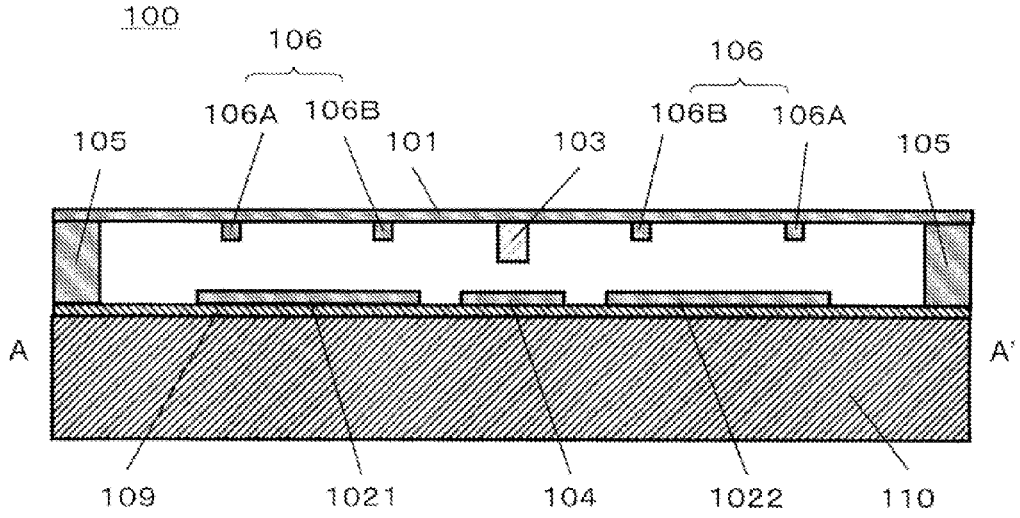
FIG. 2 is a cross-sectional view along a line A-A' in FIG. 1 showing a construction of the MEMS switch in "off" state.
Figure 3:
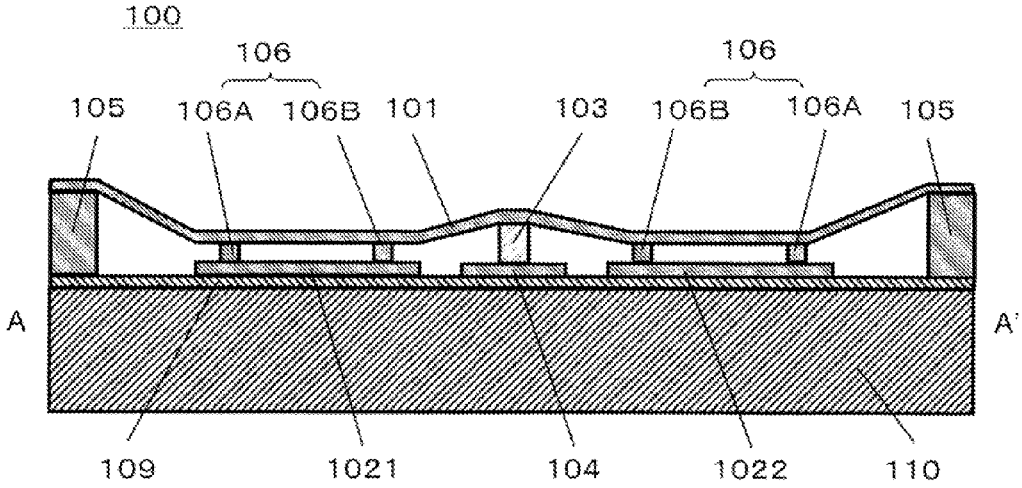
FIG. 3 is a cross-sectional view along a line A-A' in FIG. 1 showing a construction of the MEMS switch in "on" state.

FIG. 1 is a top view showing a construction of a MEMS switch according to a first embodiment of the present invention. FIG. 2 shows a cross-sectional view along the A-A' line in FIG. 1 showing a construction of the MEMS element in "off" state. FIG. 3 shows a cross-sectional view along the line A-A' in FIG. 1 showing a construction of the MEMS switch in "on" state.

The MEMS switch 100 shown in FIGS. 1 to 3 is a series-type. In this switch, an insulating layer 109 is provided, which is to be an interlayer insulating film, on a substrate 110, and on the insulating layer 109, a driving electrode 1021, a driving electrode 1022 and a signal electrode 104 as a second electrode which becomes a transmission path of a signal are formed. A movable electrode 101 of a fixed-fixed beam type as a first electrode is provided, which is bridged by two supports 105 such that it is opposed to and separated from these electrodes. The movable electrode 101 is a deformable member, and can be referred to as a movable part. In the movable electrode 101, a contact electrode 103 which is to contact with the signal electrode 104, and bumps 106 (106A, 106B) which are to contact with the driving electrodes 1021, 1022 are arranged.

In this embodiment, the electrostatic force is generated between the movable electrode as the first electrode and the counter electrode that is divided to form the driving electrodes 1021 and 1022 to which the voltage is applied. Therefore, the driving electrodes 1021 and 1022 correspond to the third electrode and the fourth electrode respectively. The driving electrode may be referred to as a "fixed electrode" since it is not movable.

Next, a mechanism of switching in the MEMS switch 100 is described.

When the switch is in the "off" state, driving voltages $V_{d1}$ and $V_{d2}$ are not applied between the movable electrode 101 and the driving electrodes 1021, 1022. The movable electrode 101 is located in an initial position where the electrode 101 is not displaced, and the contact electrode 103 is in a state of out-of-contact with the signal electrode 104. Therefore, a conduction path for the signal is not formed between the signal electrode 104 on an input port side (IN) and that on an output port side (OUT). More specifically, since an electrostatic capacitance $C_c$ formed with an air gap interposed between the signal electrode 104 and the contact electrode 103 is made a small value, the state of high AC impedance is established when a radio-frequency signal is transmitted. As a result, an electric power of the radio-frequency signal decays significantly, which causes the state wherein the radio-frequency signal cannot be transmitted between the signal electrode 104 on the input port side and that on the output port side.

When the switch is made "on" state, the driving voltages $V_{d1}$ and $V_{d2}$ are applied between the movable electrode 101 and the driving electrodes 1021, 1022 respectively. That causes electrostatic force to act so that the movable electrode 101 is attracted to the substrate 110 side, and the contact electrode 103 and the signal electrode 104 electrically contact with each other. When the contact between the contact electrode 103 and the signal electrode 104 is of a resistively-coupled type due to a metal-to-metal contact, the resistance $R_c$ results in a low value, and the conduction path of the signal is formed, and the signal is transmitted from the signal electrode 104 on the input port side to the signal electrode 104 on the output port side through the contact electrode 103.

When switching from the "on" state to the "off" state, electric potentials of the movable electrode 101 and of the driving electrodes 1021, 1022 are adjusted to be the same to eliminate the electrostatic force and the spring force of the movable electrode 101 returns the electrode 101 to its initial position. In this manner, opening and closing of the signal transmission path is performed.

Figure 4:
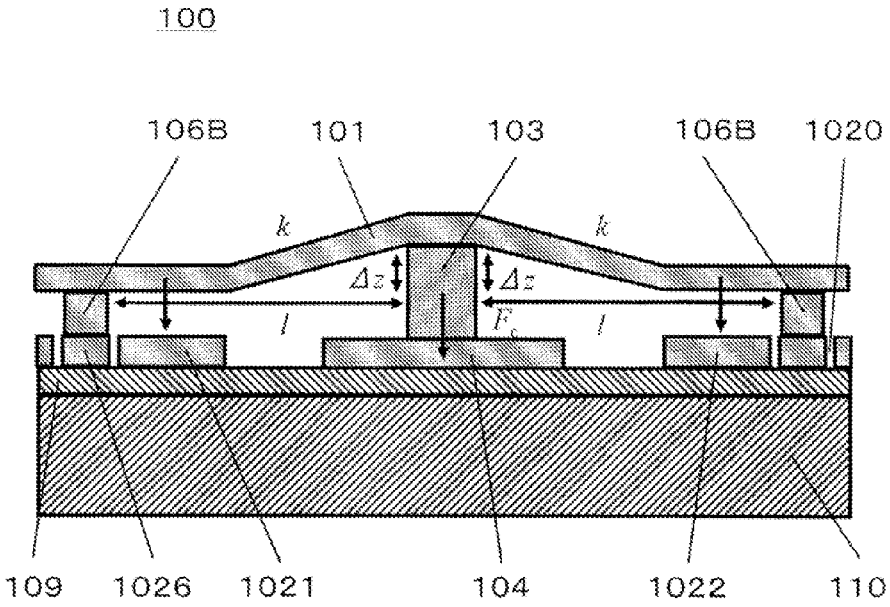
FIG. 4 is a cross-sectional view along a line A-A' in FIG. 1 showing a construction near an electrical contact in "on" state.

FIG. 4 is a cross-sectional view along a line A-A' in FIG. 1 showing the construction near the electrical contact when MEMS switch of the present embodiment is in the "on" state.

In the "on" state, the bumps 106B provided on the movable electrode 101 makes contact with floating-island electrodes 1026. The floating-island electrodes 1026 are a layer which is made from the same material and have the same thickness as the driving electrodes 1021, 1022, and parts separated physically and electrically from the driving electrodes 1021, 1022 by slits 1020. Because of the presence of the floating-island electrodes 1026, the movable electrode 101 and the driving electrodes 1021, 1022 do not have the same electric potential, and therefore, the electrostatic force can be maintained. In addition, according to the method of forming the floating-island electrodes 1026 by the slits 1020, a simplification of the production process can be achieved since the floating island electrodes 1026 can be formed in the same layer as that of the driving electrodes 1021, 1022 in one step. Furthermore, the formation of the floating-island electrodes 1026 makes it possible to form the bumps 106 from the same material as that of the contact electrode 103. The simplification of the production process can be achived in that point.

A spring constant of the movable electrode 101 after the contact is made depends on a region bridged between a plurality of bumps 106 and the contact electrode 103. The spring constant is increased relative to that in a state of the initial position because of the decrease in the region. The arrangement of the bumps 106 and the contact electrode 103 is set, such that the spring force of the movable electrode after the contact is made is larger than the electrostatic force in order that the movable electrode 101 and the driving electrodes 1021, 1022 do not contact with each other by a second pull-in after the contact is made. Such arrangement forms gaps between the movable electrode 101 and the driving electrodes 1021, 1022 after the contact is made, and establishes point contacts by the bumps 106. That enables the avoidance of the charging in the contact interface due to the direct contact of the movable electrode and the driving electrodes 1021, 1022. And that enables the avoidance of the reduction in reliability due to the stiction between the movable electrode and the driving electrodes 1021, 1022.

The height of the contact electrode 103 is set higher than that of the gap such that the contact force by the spring force also acts after the electrical contact is formed. In other words, it is preferable to select the heights (or the thicknesses) of the contact electrode 103 and the bumps 106 such that the position of the movable electrode 101 in which the contact electrode is provided is higher than the positions of the movable electrode 101 in which the bumps are provided when viewed from the substrate 110. The height of the contact electrode 103 is preferably higher than those of the bumps 106 since the thickness of the movable electrode 101 is typically constant. The movable electrode 101 of the length l bridged between the bumps 106B and the contact electrode 103 applies a spring force $F_s=k\Delta z$, which depends on the deflection spring constant k and the height difference $\Delta z$, to the contact between the contact electrode 103 and the signal electrode 104. A contact force $F_c=F_s+F_e$ is applied to the contact due to the construction in which the gaps are formed between the movable electrode 101 and the driving electrodes 1021, 1022 to continue to apply the electrostatic force $F_e$. It should be noted here that the length l of the movable electrode 101 means the difference between a x-coordinate of the side edge of the movable electrode 101 and the x-coordinate of the side edge of the bump whose x-coordinate of the side edge is closest to the x-coordinate of the side edge of the movable electrode 101 among the x-coordinates of the side edges of a plurality of bumps (that is, a distance in the x direction).

The construction of the present embodiment makes it possible to maintain high contact force by the electrostatic force in addition to the spring force (or the elastic force) even after the contact, which achieves the formation of the highly reliable contact which achieves the low contact resistance and the low insertion loss at the low driving voltage.

Figure 5:
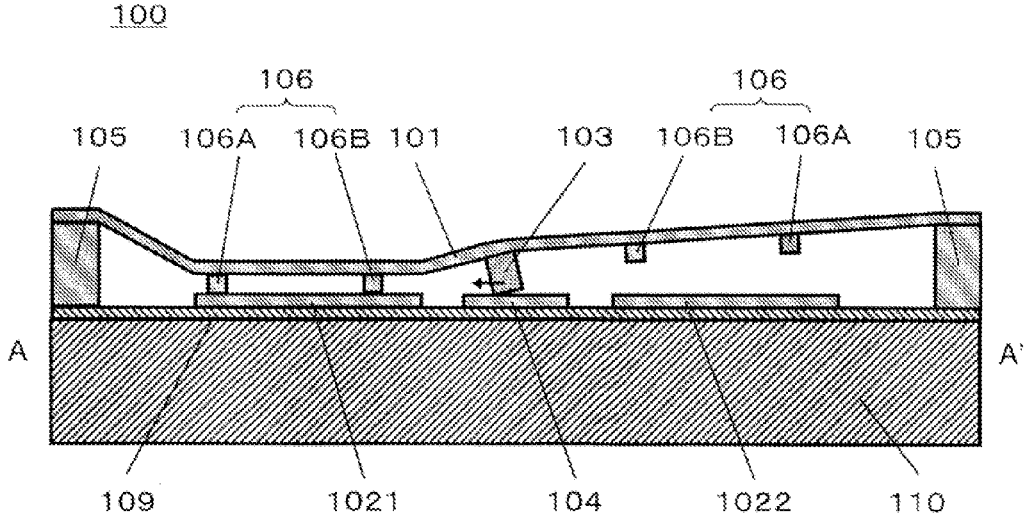
FIG. 5 is a cross-sectional view along a line A-A' in FIG. 1 showing state wherein a driving voltage is applied only between the first electrode and the third electrode.
Figure 6:
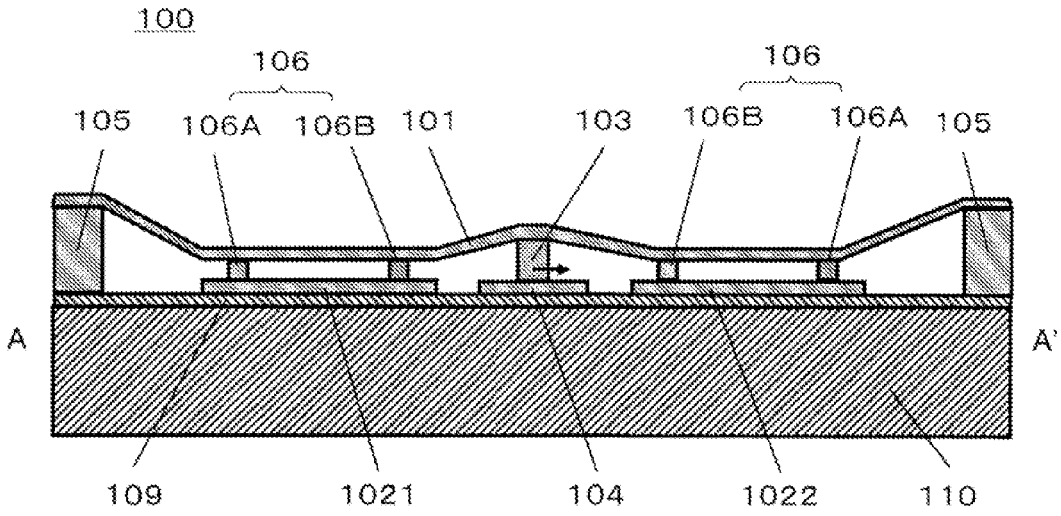
FIG. 6 is a cross-sectional view along a line A-A' in FIG. 1 showing state wherein a driving voltage is applied between the first electrode and the third electrode and between the first electrode and the fourth electrode.
Figure 7:
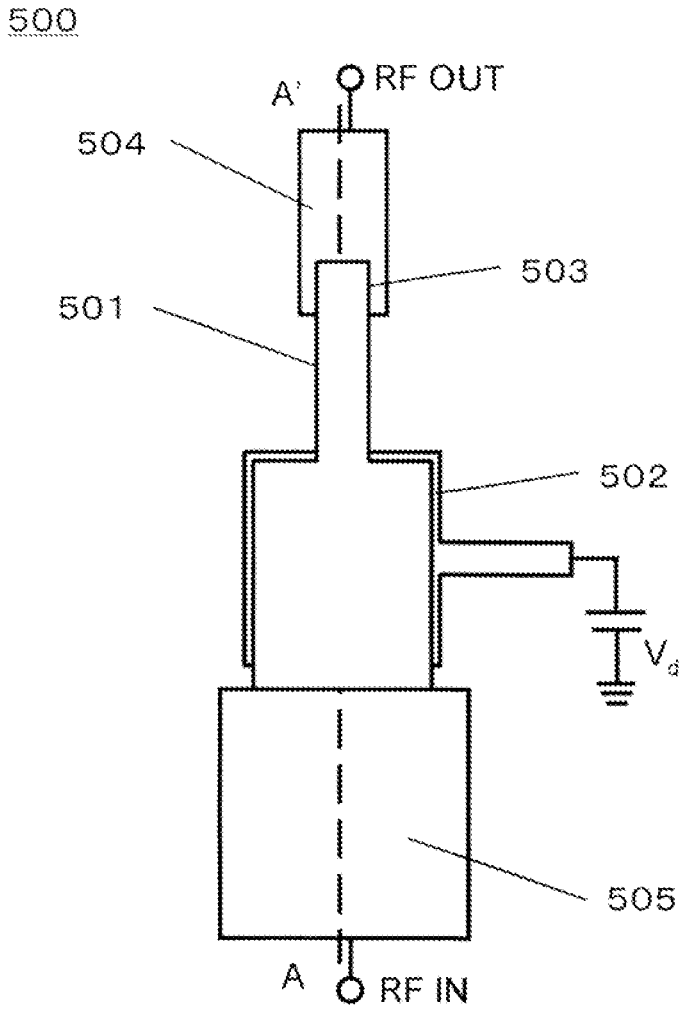
FIG. 7 is a top view showing a construction of a conventional MEMS switch.
Figure 8:
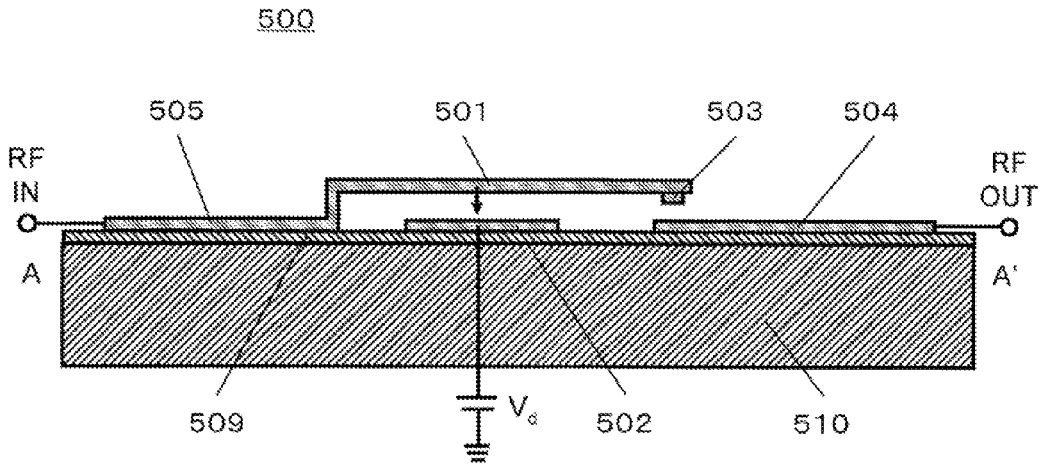
FIG. 8 is a cross-sectional view along a line A-A' in FIG. 7.

Next, the state of the switch is specifically described, wherein the control signals are input to the driving electrode 1021 as the third electrode and the driving electrode 1022 as the fourth electrode with the time difference. FIGS. 5 and 6 are the cross sectional view along the A-A' line in FIG. 1 and illustrate the state wherein the control signals are input to the two driving electrodes independently. The mechanism of this MEMS switch 100 is described.

The control signals are transmitted to the driving electrodes 1021 and 1022 for applying the driving voltages $V_{d1}$ and $V_{d2}$ between the movable electrode 101 and the driving electrode 1021 and between the movable electrode 101 and the driving electrode 1022 respectively. In this embodiment, the control signal for applying the voltage to the driving electrode 1021 is firstly transmitted and, after a predetermined time, the control signal for applying the voltage to the driving electrode 1022 is transmitted. When the control signal for applying the voltage to the driving electrode 1021 is transmitted, the movable electrode 101 is attracted to the driving electrode 1021 side and a side of the contact electrode 103 which side is nearer to the driving electrode 1021 firstly contacts with the signal electrode 104 and then the contact signal 102 is slid on the signal electrode 104 toward the driving electrode 1021 (that is, in a direction shown by an arrow in FIG. 5).

Next, when the voltage is applied to the driving electrode 1022, the movable electrode 101 is attracted to the driving electrode 1022 side, and the contact electrode 103 is slid toward the driving electrode 1022 side (that is, in a direction shown by an arrow in FIG. 6). When the bump 106 contacts with the driving electrode 1022, the entire of the contact electrode 103 applies downward force against the signal electrode 104. In this manner, the movable electrode 101 can contact asymmetrically and the contact electrode 103 can slide on the signal electrode 104 by the time difference in the input of the control signals to the two driving electrodes, resulting in the formation of the contact.

In the illustrated embodiment, when the voltage is applied to the driving electrode 1021, only the bump contacts with the driving electrode (the floating-island electrode 1026 in the illustrated embodiment) and the movable electrode 101 and the driving electrode 1021 do not contact in a broad area. In other words, the contact area between the movable electrode 101 and the driving electrode 1021 is small, and therefore frictional force generated therebetween in a direction parallel to the surface of the substrate 110 is small. For this reason, when the voltage is applied to the driving electrode 1022, the movable electrode 101 is less inhibited from being attracted to the driving electrode 1022, due to the friction force between the movable electrode 101 and the driving electrode 1021, and thereby the contact electrode 103 is slid on the signal electrode 104 more easily.

It is preferable that the time difference in the application of the voltages to the driving electrodes 1021 and 1022 is approximately equal to the response time of the switch. When, the voltage is applied with such a time difference, the contact electrode 103 can be slid on the signal electrode 104 smoothly. This is because the movable electrode 101 is attracted to the driving electrode 1022 from the state wherein the driving operation has been almost completed by the driving electrode 1021 and the movable electrode 101 has been deformed asymmetrically. The response time of the switch depends on the application of the device wherein the switch is mounted, and is typically several microseconds to several hundreds of microseconds. When the time difference is too small, the contact electrode 103 may not be slid sufficiently. When the time difference is too large, it may be difficult to deform the movable electrode 101 being in the state wherein it has been deformed asymmetrically (that is, to change the state from that shown in FIG. 5 to that shown in FIG. 6).

When switching from the "on" state to the "off" state, electric potentials of the movable electrode 101 and of the driving electrode 1021 are adjusted to be the same and then the electric potentials of the movable electrode 101 and of the driving electrode 1022 are adjusted to be the same to eliminate the electrostatic force. As a result, the spring force of the movable electrode 101 returns the electrode 101 to its initial position. Also when the switching to the "off" state, the electrical contact is released by restoring the movable electrode 101 asymmetrically by establishing the time difference in sending the control signal to two driving electrodes with the time difference, so as to slide the contact electrode 103 on the signal electrode 104 to separate the contact electrode 103 from the signal electrode 104. That is, the mechanical cleaning effect is also obtained upon the release of the electrical contact and good electrical contact can be obtained in the next electrical contact. This opening and closing of the transmission path of the signal makes it possible to form the contact of low contact resistance repeatedly and stably by the slide action of the contact electrode 103 upon the contact and separation between the contact electrode 103 and the signal electrode 104.

In this embodiment, the movable electrode 101 is of a fixed-fixed beam construction wherein both ends thereof are fixed. When the movable electrode is of the fixed-fixed beam construction, the movable electrode 101 is surely pulled toward a right side after it has been pulled toward a left side as shown in FIG. 5. Therefore, the contact electrode 103 is more surely slid toward the right side after it has been slid toward the left side as shown in FIG. 5, resulting in high mechanical cleaning effect.

Further, the construction of the present embodiment makes it possible to obtain high contact force at the electrical contact, resulting in the decrease in the physical contact area between the contact electrode 103 and the signal electrode 104 in the MEMS switch. This makes it possible to avoid the reduction in reliability due to the stiction.

As shown in FIG. 1, the driving electrodes 1021, 1022 are arranged to sandwich the contact electrode 103 therebetween in this embodiment. In other words, the driving electrodes 1021, 1022 are arranged on the both sides of the contact electrode 103 when a direction parallel to the signal electrode 104 (a vertical (top and bottom) direction in FIG. 1) is defined as a longitudinal direction and the direction perpendicular to the longitudinal direction is defined as a width direction. Furthermore, in the illustrated embodiment, the driving electrodes 1021, 1022 are arranged symmetrically about the signal electrodes 104 and the contact electrode 103 connecting therebetween as a centerline. Such arrangement makes it possible to apply uniform contact force without a bias to the entire contact between the contact electrode 103 and the signal electrode 104 in the "on" state (the state shown in FIG. 6), avoiding the dispersion of the contact force.

In the illustrated embodiment, the bumps 106 are arranged to be symmetrical about the signal electrodes 104 and the contact electrode 103 connecting therebetween as a centerline when viewed from above. Such arrangement makes the gaps formed on the both sides of the contact electrode 103 symmetrical, which contributes to the exertion of the uniform contact force without a bias to the both sides of the contact electrode 103. The bumps 106 may be arranged to be asymmetrical as needed, or may be arranged to be opposed to only one driving electrode as needed.

As shown in the figure, it is preferable to provide a plurality of bumps 106 and to arrange the bumps in the positions different from each other such that the distance between the respective bumps 106 and the electrical contact are the same. In the illustrated embodiment, the bumps 106 which are to contact with the driving electrodes 1021 and 1022 are provided, and the respective bumps 106 are arranged on the circumference of the circle, the center of which is the electrical contact. As shown in the figure, the distance between the electrical contact and the bump means the distance between the center of the signal electrode 103 and the bump 106 when the electrical contact and the bumps make the surface contact. By arranging the bumps in such manner, the movable electrode 101 bridged over the region surrounded by the electrical contact and the bumps is supported in not only the x direction but also the y direction. That increases the spring force of the movable electrode 101 to prevent the movable electrode 101 from being pulled against the driving electrodes 1021, 1022. As a result, the gaps between the movable electrode 101 and the driving electrodes 1021, 1022 can be ensured.

The bumps 106 are preferably arranged such that, when viewed from shove, the area of the region which is formed by connecting, by a line, the center of the electrical contact (the center of the surface contact (the signal electrode 103) when the surface contact is made as shown in the figure) and the bumps (centers of the bumps), that is, a region surrounded by the chain line in FIG. 1 is 20% or more of the area in which the electrostatic force acts between the movable electrode 101 and the driving electrode 1021. That ensures the wide gap regions formed by the driving electrodes 1021, 1022 and the movable electrode 101 bridged between the bumps 106 and the contact electrode 103 after the contact is made. Widened gap regions decrease the spring force of the movable electrode 101, and increase the areas where the movable electrode 101 and the driving electrodes 1021, 1022 are opposed to each other in the gap regions to increase the electrostatic force. That makes it possible to continue to apply the electrostatic force to the contact even after the contact is made.

For example, in the embodiment shown in the figure, the distance from the electrical contact to each bump can be set at most 0.3 mm when the total area of the two driving electrodes is 1 $mm^2$, the driving voltage is 7 V, the thickness of the movable electrode is 8 μm, and the gaps of 0.2 μm are to be formed between the driving electrodes and the movable electrode after the contact electrode 103 contacts with the signal electrode 104. In this case, the total area of the regions surrounded by the electrical contact and the bumps is 0.23 $mm^2$, corresponding to 23% of the areas in which the electrostatic force acts between the movable electrode and the driving electrodes.

The number and the positions of the bumps 106 are selected in view of the properties and the size and so on of the movable electrode 101. The bumps are preferably arranged such that they are not located near the electrical contact and are located on the periphery of the driving electrodes 1021, 1022. That makes it possible to increase the area of the region in which the electrostatic force acts between the movable electrode 101 and the driving electrode 1021. In this embodiment, the bumps 106 are arranged on the approximate vertices of the driving electrodes 1021, 1022 which are approximate triangles when viewed from above, increasing the region surrounded by the electrical contact and the bumps as much as possible. As a result, the gap regions are large and the electrostatic capacitance is increased so that the electrostatic force can be increased which is force that maintains the contact between the contact electrode 103 and the signal electrode 104 after the contact is made.

Further, it is preferable to form the bumps 106, selecting the number and the positions of the bumps such that the movable electrode 101 does not contact directly with the driving electrodes 1021, 1022. The contact force by the electrostatic force cannot be obtained the movable electrode and the driving electrodes contact each other. It is preferable to significantly warp the movable electrode by adjusting the distance between the bump and the movable electrode and the distance between the bumps, since the larger spring force can be obtained as $\Delta Z$ is larger as described above. However, the electrostatic force $F_e$ cannot be obtained when these distances are too large so that the warped movable electrode contacts the driving electrodes. To avoid that, it is preferable to set the positions and the number of the bumps considering the spring constant and so on of the movable electrode 101.

As described above, according to the MEMS switch 100 of this embodiment, it is possible to provide the microelectromechanical system switch which achieves the highly reliable contact that was previously difficult to achieve, and the electric device using the MEMS switch. This MEMS switch can be used in various electric devices, in particular, a communication device. Particularly, it can be used in the mobile phone, a transmitting and receiving part of a wireless communication terminal and an antenna device.

In the illustrated embodiment, the MEMS switch has a regular octagonal shape when viewed from above. The shape of MEMS switch of the present invention is not limited to this, and the MEMS switch can have another shape such as square, regular hexagon, circle, oval, rectangular or triangle.

The present invention can apply to a switch, wherein a contact part between the movable electrode and the signal electrode in which the signals are coupled on an equivalent circuit of the MEMS switch is connected in parallel to the transmission line, and the edge of the contact part is connected to ground (a shunt-type switch). In the shunt-type switch, the positions of the movable electrode in the "on" state and the "off" state are opposite to those of the series type switch. In the "off" state, the movable electrode makes contact with the signal electrode. Signals are transmitted to the ground, and not to the output port. In the "on" state, the movable electrode does not make contact with the signal electrode, and signals are transmitted through the signal electrode from the input port to the output port.

In another embodiment of the present invention, the bumps which are provided on the movable-electrode side in the first embodiment may be provided on the driving-electrode side.

In further embodiment of the present invention, the bumps may be made from the insulator. In this case, the movable electrode and the driving electrode are prevented from having the same potential even if the floating-island electrodes are not provided within the driving electrode.

A production method of the MEMS switch of any embodiment (including the following embodiment(s)) is not especially limited to a specific one. For example, the movable electrode can be formed to be of a fixed-fixed beam type or a cantilever-type by etching with a sacrifice layer. The contact electrode is formed by forming a concave in the sacrifice layer by etching and then deposing a material of the contact electrode within the concave, which material may be the same as that of the movable electrode. The contact electrode is preferably formed from a material such as platinum or ruthenium or the like. Since such material is of low resistance and high rigidity, the electrical contact of low contact resistance and high reliability can be given. Further, the contact electrode 103 is preferably rectangular parallelepiped with a rectangular section or a square section. Since the contact electrode 103 having such a shape is slid on the signal electrode 104 with one side of the rectangular parallelepiped in line contact with the signal electrode, the mechanical cleaning effect can be obtained in a wide range.

When the bumps are formed on the movable electrode, the movable electrode with bumps is formed by forming, in the sacrifice layer, concaves different from that for forming the contact electrode by masking and etching, depositing the material of the movable electrode within the concaves and on the surface of the sacrifice layer, and then removing the sacrifice layer. The material of the bumps may be different from that of the movable electrode, for example, an insulator. The insulating layer may be formed by thermally oxidizing the surface of the substrate made from silicon. The thickness of the insulating layer may be, for example, about 1 μm.

The driving electrodes as the third electrode and the fourth electrode and the signal electrode as second electrode are formed by depositing the respective electrode materials on the insulating layer, and patterning by masking and etching. The thicknesses of the driving electrodes as the third electrode and the fourth electrode and the signal electrode as the second electrode may be about 0.5 to 1.0 μm. When the floating-island electrodes are formed within the third and the fourth electrodes, those are formed by making slits in the same mask, and separating the floating-island electrodes from the third and the fourth electrodes by the etching process.

Further, in the MEMS switch of the present invention, it is necessary to provide input circuits for control signals to the third electrode and the fourth electrode independently such that the control signals are input to these electrodes independently, for the purpose of applying the voltage with the time difference. The control of these circuits makes it possible to establish the desired time difference in the input of the control signals to the two electrodes. In addition, the electrical potentials $V_{d1}$ and $V_{d2}$ at the two electrodes can be different from each other.

When $V_{d1}$ is applied and then $V_{d2}$ is applied, the amount of $V_{d2}$ is set depending on the spring force of the first electrode (the movable electrode 101) in the state wherein $V_{d1}$ is applied, and the distance of the gap between the first electrode (the movable electrode 101) and the fourth electrode (the driving electrode 1022). In general, the spring force of the first electrode in the state where $V_{d1}$ is applied is larger than that of the first electrode in the state where $V_{d1}$ is not applied, and a larger electrostatic force is required in order to warp the first electrode in the state where $V_{d1}$ is applied. Further, the gap distance between the first electrode and the fourth electrode in the state where $V_{d1}$ is applied is smaller than that in the state wherein $V_{d1}$ is not applied and the electrostatic necessary for contacting the first electrode with the fourth electrode is smaller.

Second Embodiment

The embodiment in which the counter electrode is divided to construct the driving electrodes 1021 and 1022 as the third and the fourth electrodes is described in the first embodiment.

Figure 9:
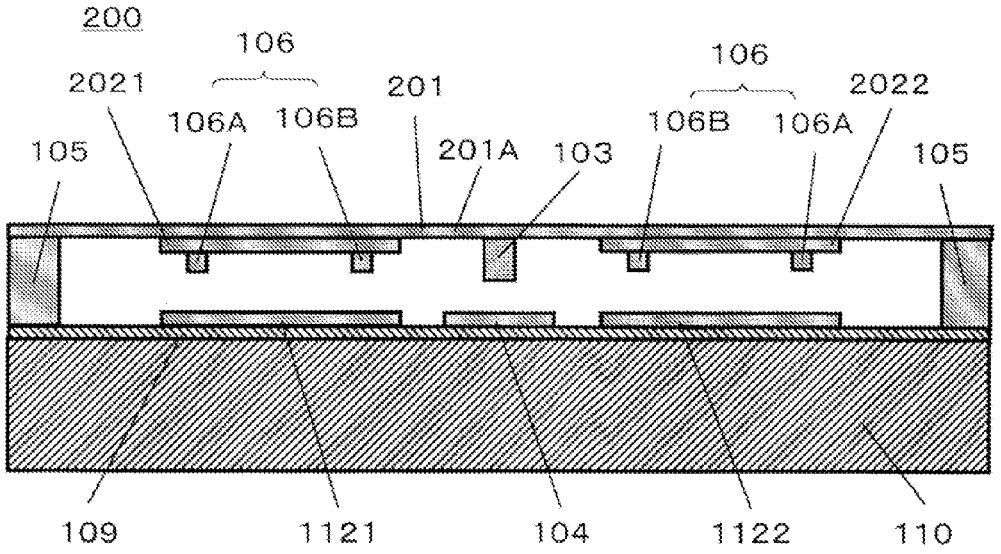
FIG. 9 is a cross-sectional view showing a construction of a MEMS switch according to a second embodiment of the present invention.

As a second embodiment, an embodiment wherein the movable electrode is divided into two separate electrodes and the voltage is applied to the separate movable electrodes with a time difference is described. FIG. 9 is a cross-sectional view showing the construction of the MEMS switch of the second embodiment. The top view of this MEMS switch is approximately the same as that of the first embodiment (i.e. FIG. 1), and FIG. 9 shows the A-A' cross section in FIG. 1.

In the MEMS switch 200 shown in FIG. 9, the insulating layer 109 which is to be an interlayer insulating film 109 is provided on the substrate 110, and two counter electrodes 1121 and 1122 and the signal electrode which is to be the transmission path of the signal are provided on the insulating layer 109. A movable electrode 201 of the fixed-fixed beam type is provided, which is bridged with two supports 105 such that it is opposite to these electrodes and separated from these electrodes. In the illustrated embodiment, the movable electrode consists of two layers, one layer being a bridging layer 201A bridged by the supports and the other layer being a driving electrode layer 2021 and 2022 which is a layer for applying the voltage. The movable electrode is substantially divided by these driving electrodes layers 2021 and 2022, whereby the voltage can be applied to the respective driving electrode layers with a time difference.

In the movable electrode 201, the contact electrode 103 which is to make contact with the signal electrode 104 is provided and the bumps 106 (106A, 106B) which are to contact with the counter electrodes 1121 and 1122 are provided. The electrostatic force between the movable electrode 201 and the counter electrodes 1121 and 1122 is generated by applying the voltage to the driving electrode layers 2021 and 2022 of the movable electrode 201. The counter electrodes 1121 and 1122 may be referred to as the "fixed electrode" since they are not movable also in this embodiment.

In the movable electrode 201, the bridging layer 201 is required to be electrically insulated by an insulator from the driving electrodes layers 2021 and 2022 so that the applications of the voltages to the driving electrode layers 2021 and 2022 do not affect each other. Alternatively, the independency of two driving electrode layers may be ensured by forming the bridging layer 201 from the insulator. The driving electrode layers 2021 and 2022 are preferably formed such that they have substantially the same shapes and sizes as those of the counter electrodes 1121 and 1122.

The mechanism of the switching in the MEMS switch 200 is as described in connection with the first embodiment except that the voltage is applied to the driving electrode layers 2021 and 2022. Therefore, the detailed description thereof is omitted. In addition, also in this embodiment, it is preferable to construct the counter electrodes 1121 and 1122 such that the bumps 106 make contact with the floating-island electrodes. Further, preferable construction of each member described in connection with the first embodiment can be also preferably employed also in this embodiment. Furthermore, effects achieved in the MEMS switch of this embodiment are also as described in connection with the first embodiment.

Third Embodiment

The first embodiment and the second embodiment are embodiments wherein the bumps are provided on the movable electrode. However, the bump is not necessarily required. As a third embodiment, an embodiment wherein no bumps are provided is described.

Figure 10:
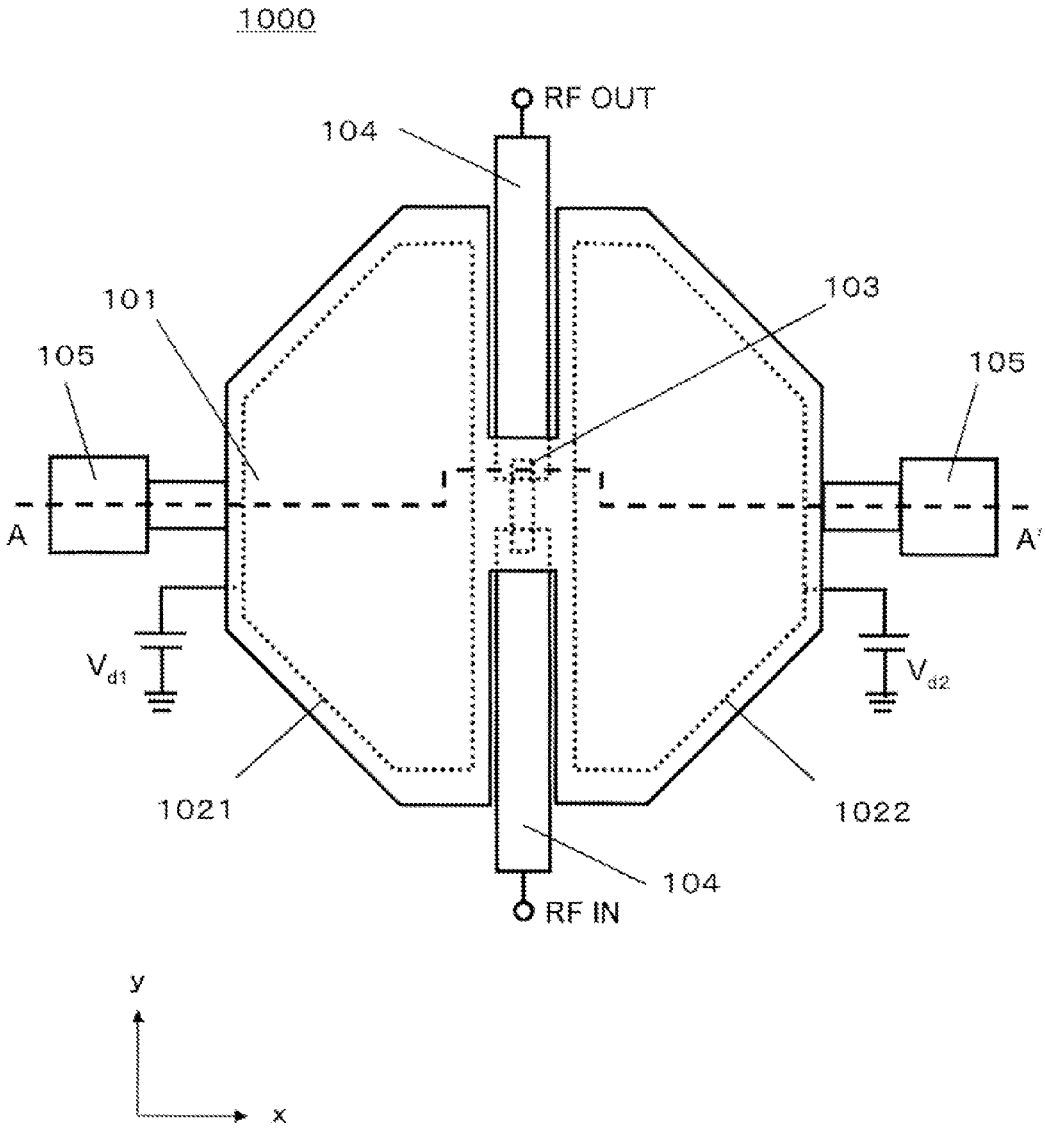
FIG. 10 is a cross-sectional view showing a construction of a MEMS switch according to a third embodiment of the present invention.
Figure 11:
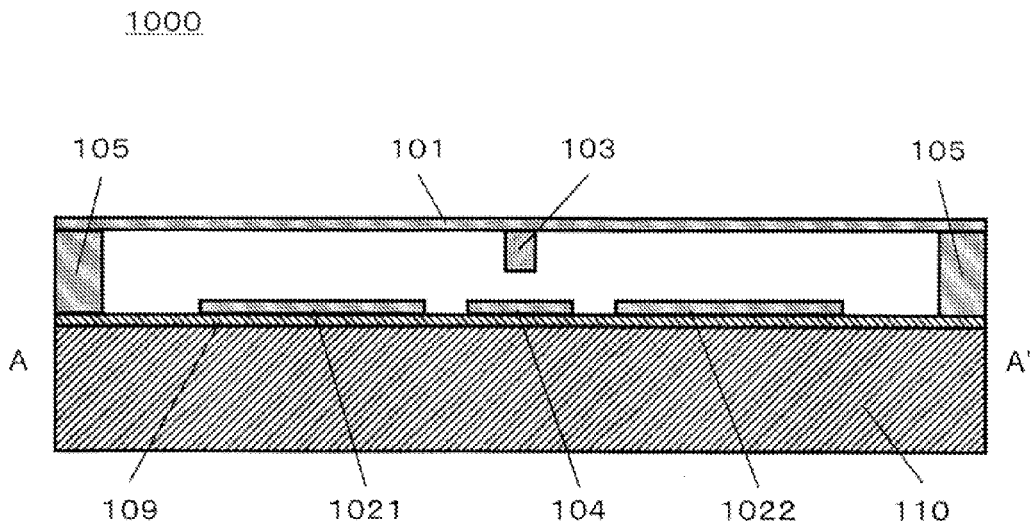
FIG. 11 is a cross-sectional view along a line A-A' in FIG. 10 showing a construction of the MEMS switch in "off" state.
Figure 12:
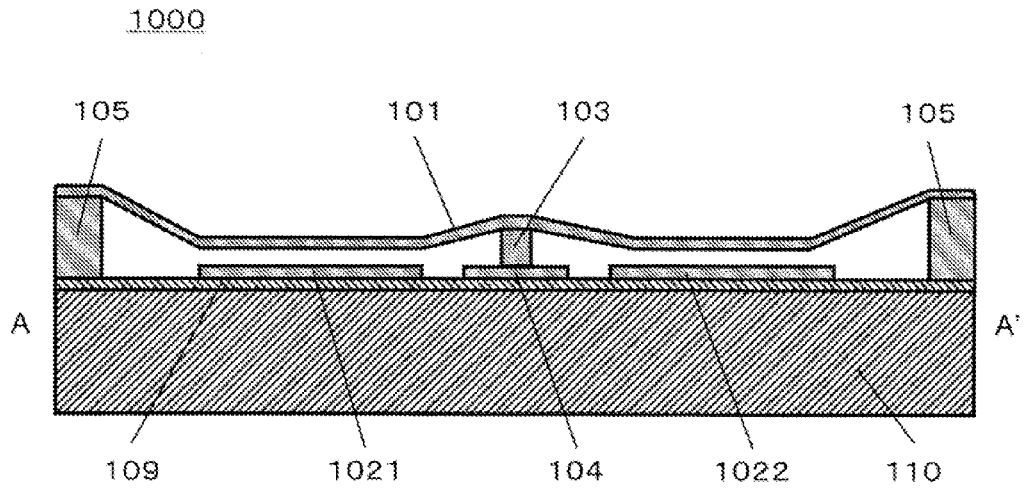
FIG. 12 is a cross-sectional view along a line A-A' in FIG. 10 showing a construction of the MEMS switch in "on" state.

FIG. 10 is a top view showing the construction of the MEMS switch according to the third embodiment of the present invention. FIG. 11 is a cross-sectional view along the A-A' line in FIG. 10 showing the construction of the MEMS switch in the "off" state. FIG. 12 is a cross-sectional view along the A-A' line in FIG. 10 showing the construction of the MEMS switch in the "on" state.

The MEMS switch 1000 shown in FIGS. 10 to 12 has the same construction as that of the MEMS switch of the first embodiment except that it does not include the bump. Therefore, the same member or the element is denoted by the same reference sign. Also in the MEMS switch 1000 provided with no bumps, the on/off operation of switching can be made according to the same mechanism as that of the first embodiment by conducting the method of inputting the control signal employed in the MEMS switch 100 of the first embodiment. That is, also in this embodiment, the contact electrode 103 can be slid on the signal electrode 104 by applying the voltage to the driving electrode 1021 and then applying the voltage to the driving electrode 1022. That gives the mechanical cleaning effect to achieve the stabilization of the contact formation in the repeated operations. As shown in the figure, also in the embodiment having no bumps, it is preferable to ensure the gaps between the movable electrode 101 and the driving electrodes 1021 and 1022 so as to exert the electrostatic force therebetween while the electrical contact is made. To this end, the movable electrode 101 and the circuit are required to be designed and the control signal is required to be adjusted, such that the movable electrode 101 does not contact with the driving electrodes 1021 and 1022 by the application of the voltage.

Fourth Embodiment

Figure 13:
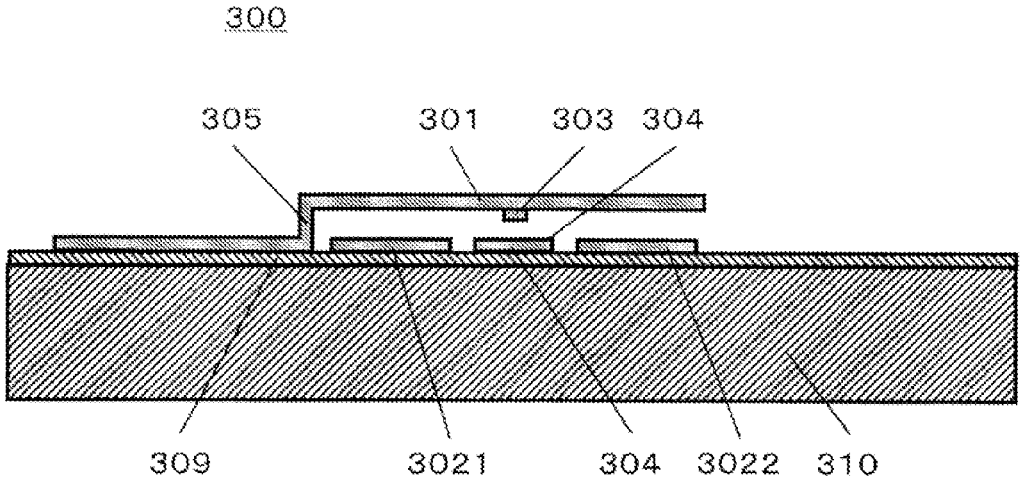
FIG. 13 is a cross-sectional view showing a construction of a MEMS switch according to a fourth embodiment of the present invention.

In the first to the third embodiments, the switch wherein the movable electrode is of the fixed-fixed beam type is described. As a fourth embodiment, an embodiment is described in which the movable electrode is of the cantilever type. In the MEMS switch 300 shown in FIG. 13, an insulating layer 309 which is to be an interlayer insulating film is provided on a substrate 310, driving electrodes 3021 and 3022 and a signal electrode 304 which is to be the transmission path of signal are provided on the insulating layer 309. The movable electrode 301 having a contact electrode 303 is provided, which is supported by the supports 305 such that it is opposed to and separated from these electrodes.

In this embodiment, the counter electrode which is opposed to the movable electrode is divided into two electrodes to form driving electrodes 3021 and 3022 and the application of the voltage is conducted with the time difference. Also in this embodiment, the bump is not provided on the movable electrode. In the case where the movable electrode is of the cantilever type, the bump may be provided as necessary.

The mechanism of the switching in the MEMS switch 300 is as described in connection with the first embodiment. Particularly, the voltage is applied to one of the driving electrodes 3021 and 3022 and then the voltage is applied to the other electrode with a time difference which is preferably approximately the same as the response time of the switch. Thereby, the contact electrode 303 in contact with the signal electrode 304 is slid toward the side of the driving electrode to which the voltage is applied later, giving the mechanical cleaning effect. As a result, the contact resistance can be made low at the electrical contact. Further, also in this embodiment, since the movable electrode 301 is constructed such that the movable electrode 301 does not contact with the driving electrodes 3021 and 3022 directly, high contact force can be maintained by the electrostatic force generated between the movable electrode and the driving electrode.

INDUSTRIAL APPLICABILITY

The MEMS switch of the present invention can achieve the high reliability and the low insertion loss, and thus, it is useful as a part of an electric device such as a communication device.

REFERENCE SIGNS LIST

100, 200, 300, 500, 1000 MEMS switch
101, 201, 301 Movable electrode
1020 Slit
1021, 1022, 3021, 3022 Driving electrode
1026 Floating-island electrode
103, 303 Contact electrode
104, 304 Signal electrode
105, 305 Support
106, 106A, 106B Bump
109, 309 Insulating layer
110, 310 Substrate
201A Bridging layer
2021, 2022 Driving electrode layer
1121, 1122 Counter electrode
301, 501 Movable electrode
502 Driving electrode
503 Contact electrode
505 Support
509 Insulating layer

The invention claimed is:

1. A MEMS switch comprising:

a movable electrode, a signal electrode which is separated from and opposed to the movable electrode, and a counter electrode which is separated from and opposed to the movable electrode, wherein, the movable electrode is configured to move and make electrical contact with the signal electrode due to an electrostatic force generated between the movable electrode and the counter electrode, one of the movable electrode and the counter electrode is divided into two or more electrically-separate electrodes and is configured to receive electrical voltage which generates the electrostatic force between the movable electrode and the counter electrode, the electrical voltage is applied to the respective electrically-separate electrodes with a time difference, and the electrically-separate electrodes are disposed symmetrically about the signal electrode wherein the electrical voltage applied to the electrically-separate electrodes with the time difference includes a first voltage applied to the first one of the electrically-separate electrodes and a second voltage different than the first voltage applied to the second one of the electrically-separate electrodes.

2. The MEMS switch according to claim 1, wherein the time difference is approximately equal to a response time of the MEMS switch.

3. The MEMS switch according to claim 1, wherein the movable electrode is a first electrode, the signal electrode is a second electrode, and the counter electrode is divided into the electrically-separate electrodes to form a third electrode and a fourth electrode.

4. The MEMS switch according to claim 3, further comprising at least one bump, wherein the at least one bump can form a contact between the first electrode and the third electrode and/or between the first electrode and the fourth electrode is formed on one or more electrodes selected from the first electrode, the third electrode and the fourth electrode, a gap is formed between the first electrode and the third electrode and/or between the first electrode and the fourth electrode when the electrical contact is made between the first electrode and the second electrode.

5. The MEMS switch according to claim 4, wherein the at least one bump is configured such that the first electrode does not contact directly with the third electrode and/or the fourth electrode when the electrical contact is formed.

6. The MEMS switch according to claim 4, wherein the at least one bump is a plurality of bumps and the bumps are disposed respectively on a plurality of lines which radiate from the electrical contact.

7. The MEMS switch according to claim 6, wherein the bumps are placed so that distances between the electrical contact and the respective bumps are equal and positions of the bumps are different from each other.

8. The MEMS switch according to claim 4, wherein the at least one bump is a plurality of bumps formed between the first electrode and the third electrode, and a number and positions of the bumps are selected so that an area of a region enclosed by the electrical contact and the bumps is 20% or more of an area where the electrostatic force acts between the first electrode and the third electrode.

9. The MEMS switch according to claim 4, wherein the at least one bump is a plurality of bumps formed between the first electrode and the fourth electrode, and a number and positions of the bumps are selected so that an area of a region enclosed by the electrical contact and the bumps is 20% or more of an area where the electrostatic force acts between the first electrode and the fourth electrode.

10. The MEMS switch according to claim 4, wherein the at least one bump and a floating-island electrode formed within the third electrode and/or the fourth electrode can form the contact.

11. The MEMS switch according to claim 4, wherein the at least one bump is of an electrical insulator.

12. The MEMS switch according to claim 4, wherein the first electrode at the electrical contact is positioned at a higher level than the first electrode at the at least one bump.

13. The MEMS switch according to claim 12, wherein a contact electrode is formed on the first electrode at the electrical contact, and a height of the contact electrode is larger than the height of the at least one bump.

14. The MEMS switch according to claim 3, wherein the third electrode and the fourth electrode are placed sandwiching the electrical contact when viewed from above.

15. The MEMS switch according to claim 1, wherein the movable electrode is a fixed-fixed beam.

16. A communications device comprising the MEMS switch according to claim 1.

17. The MEMS switch according to claim 1, wherein the movable electrode and the signal electrode are configured such that the electrical contact between the movable electrode and the signal electrode establishes one conduction path of a signal.

18. The MEMS switch according to claim 1, wherein the movable electrode and the signal electrode are configured such that the electrical contact between the movable electrode and the signal electrode is made by application of the electrical voltage to both of the electrically-separate electrodes.

19. The MEMS switch according to claim 1, wherein the movable electrode, the signal electrode, and the counter electrode are configured such that applying the electric voltage to a first one of the electrically-separate electrodes and then applying the electric voltage to a second one of the electrically-separate electrodes while maintaining the electric voltage to the first one of the electrically-separate electrodes causes the electrical contact between the movable electrode and the signal electrode.

20. A MEMS switch comprising: a movable electrode, a signal electrode which is separated from and opposed to the movable electrode, and a counter electrode which is separated from and opposed to the movable electrode, wherein, the movable electrode is configured to move and make electrical contact with the signal electrode due to an electrostatic force generated between the movable electrode and the counter electrode, one of the movable electrode and the counter electrode is divided into two or more electrically-separate electrodes and is configured to receive electrical voltage which generates the electrostatic force between the movable electrode and the counter electrode, the electrical voltage is applied to the electrically-separate electrodes with a time difference, and the movable electrode, the signal electrode, and the counter electrode are configured such that applying the electric voltage to a first one of the electrically-separate electrodes and then applying the electric voltage to a second one of the electrically-separate electrodes while maintaining the electric voltage to the first one of the electrically-separate electrodes causes the electrical contact between the movable electrode and the signal electrode and causes the movable electrode to slide along the signal electrode upon formation of the electrical contact, wherein the electrical voltage applied to the electrically-separate electrodes with the time difference includes a first voltage applied to a first one of the electrically-separate electrodes and a second voltage different than the first voltage applied to a second one of the electrically-separate electrodes.

21. The MEMS switch according to claim 20, wherein the separate electrodes are disposed symmetrically about the signal electrode.

* * * * *